US005468332A

United States Patent [19]

Dretzka et al.

[11] Patent Number: 5,468,332

[45] Date of Patent: Nov. 21, 1995

[54] TAPE DISPENSER

[75] Inventors: Philip C. Dretzka; Tighe M. Belden; Eugene N. Reshanov, all of Minneapolis; Bruce E. Samuelson, West Lakeland, all of Minn.

[73] Assignee: Minnesota Mining And Manufacturing Company, St. Paul, Minn.

[21] Appl. No.: 129,422

[22] Filed: Sep. 29, 1993

[51] Int. Cl.[6] ..... B32B 31/00

[52] U.S. Cl. ..... 156/527; 156/577; 225/77

[58] Field of Search ..... 156/527, 577, 156/584, 574; 225/77

[56] References Cited

U.S. PATENT DOCUMENTS

| | | | |
|---|---|---|---|
| 432,107 | 7/1890 | Yarger . | |
| 1,423,701 | 7/1922 | Vinson . | |
| 2,663,369 | 12/1953 | Erhardt | 225/77 |
| 2,722,331 | 11/1955 | Vogt | 216/33 |
| 2,839,139 | 6/1958 | Vogt | 164/84.5 |
| 3,109,570 | 11/1963 | Maddalena | 225/66 |
| 3,170,613 | 2/1965 | Casey | 225/66 |
| 3,502,252 | 3/1970 | Marriani | 225/77 |
| 3,586,587 | 6/1971 | Boyce | 156/577 |
| 3,839,127 | 10/1974 | Hazuka et al. | 156/584 |
| 4,358,328 | 11/1983 | Pearson | 156/73.1 |
| 4,400,231 | 8/1983 | Martin | 156/527 |
| 4,780,172 | 10/1988 | Shea | 156/527 |
| 4,961,525 | 10/1990 | Corbo et al. | 225/65 |

FOREIGN PATENT DOCUMENTS

| | | |
|---|---|---|
| 32428/68 | 7/1970 | Australia . |
| 0104989 | 4/1984 | European Pat. Off. . |
| 1066913 | 10/1959 | Germany . |
| 2175277 | 11/1986 | United Kingdom . |
| 2201946 | 9/1988 | United Kingdom . |

OTHER PUBLICATIONS

Intgernational Search Report for counterpart foreign International Application PCT/US94/09543.

U.S. Pat. application entitled "Tape Dispensing Device" which we were advised was filed on Apr. 1, 1993, and is probably assigned to L'Arch Corporation, 2106 Gallows Road, Suite C, Vienna, Virginia 22182.

H-122 Dispenser Literature and photographs (2).

*Primary Examiner*—Mark A. Osele

*Attorney, Agent, or Firm*—Gary L. Griswold; Walter N. Kirn; William L. Huebsch

[57] ABSTRACT

A tape dispenser having a polymeric frame with a cutter support portion having a cutting edge along one end, opposite side wall portions attached along opposite side edges of the cutter support portion, opposed hub portions projecting toward each other from the side wall portions that are adapted to project into opposite ends of an opening through a tape core to rotatably support the roll of tape, and locating tab portions projecting toward each other from the side wall portions. The locating tab portions have arcuate retaining surfaces adjacent and spaced from the support portion, and have opposed cam surfaces extending from the side wall portions to the inner ends of the locating tab portions that consistently cause tape being pulled from the roll of tape on the side of the tab portions opposite the retaining surfaces to be guided around the locating tab portions when the tape is cut, whereupon the newly cut end portion of the tape will releasably adhere to the retaining surfaces to retain that end portion in a position projecting from the roll at which it can easily be manually engaged to afford withdrawing another length of tape from the roll.

24 Claims, 4 Drawing Sheets

TAPE DISPENSER

TECHNICAL FIELD

The present invention relates to manually operated tape dispensers for rolls of tape of the type from which lengths of the tape may be withdrawn while the tape is being applied to a substrate, and which include cutting means by which tape withdrawn from the dispenser may be cut from tape remaining on the roll of tape in the dispenser.

BACKGROUND ART

For many years Minnesota Mining and Manufacturing Company (3M), St. Paul, Minn., has sold a light duty or disposable prior art tape dispenser under the trade designation "Scotch(T.M.) Brand C-147 dispenser which is similar to the tape dispenser described in U.S. Pat. No. 4,358,328. That dispenser is a manually operated tape dispenser for a roll of tape from which lengths of the tape may be withdrawn and includes cutting means by which tape withdrawn from the dispenser may be cut from tape remaining on the roll of tape in the dispenser. That tape dispenser comprises a frame integrally molded of a polymeric material that comprises (1) a cutter support portion having means for defining a cutting edge along one end that is adapted to transversely cut the tape, (2) opposite side wall portions attached along opposite side edges of the cutter support portion that are disposed generally at right angles to the cutter support portion and to the cutting edge, (3) opposed hub portions projecting toward each other from the side wall portions, which hub portions are adapted to rotatably support the roll of tape for rotation about an axis by projecting into opposite ends of an opening through its core; and (4) opposed locating tab portions projecting toward each other from the side wall portions at a distance from the axis that is significantly less than the distance between the cutting edge and the axis, which locating tab portions have retaining surfaces adjacent the cutter support portion to which newly cut end portions of the tape may be releasably adhered to retain those end portions of the tape in a position projecting from the roll at which they may be manually engaged to afford withdrawing another length of tape from the roll. In that prior art tape dispenser, however, the newly cut end portion of the tape can far too easily peal or slip away from the retaining surfaces on the locating tab portions, whereupon the newly cut end portion can again adhere to the underlying wrap of tape on the roll and be difficult to separate from that roll when another length of tape is desired. After that end of the tape is subsequently pealed from the roll it can be moved between and around the tab portions to a position between the locating tab portions and the cutter support portion, however this is not done as easily as may be desired, and even when done, does not often result in subsequent newly cut end portions of the tape remaining between the locating tab portions and the cutter support portion.

For many years Minnesota Mining and Manufacturing Company, St. Paul, Minn., has also sold an industrial quality prior art tape dispenser under the trade designation "Scotch(T.M.) Brand H-122 Dispenser, Model 28300". That dispenser is a manually operated tape dispenser for a roll of tape from which lengths of the tape may be withdrawn and includes cutting means by which tape withdrawn from the dispenser may be cut from tape remaining on the roll of tape in the dispenser. That tape dispenser comprises a frame integrally molded of a polymeric material that comprises (1) a cutter support portion having means for defining a cutting edge along one end that is adapted to transversely cut the tape, (2) opposite side wall portions attached along opposite side edges of the cutter support portion that are disposed generally at right angles to the cutter support portion and to the cutting edge, (3) a hub portion projecting from one of the side wall portions, which hub portion is adapted to project into the opening in a core for the roll of tape to rotatably support the roll of tape for rotation about an axis; and (4) opposed spaced locating tab portions projecting toward each other from the side wall portions at a distance from the axis that is significantly less than the distance between the cutting edge and the axis, which locating tab portions have retaining surfaces adjacent the cutter support portion to which newly cut end portions of the tape may be releasably adhered to retain those end portions of the tape in a position projecting from the roll at which they may be manually engaged to afford withdrawing another length of tape from the roll. Also, the locating tab portions have opposed cam surfaces extending to the inner spaced adjacent ends of the locating tab portions on the sides of the locating tab portions opposite the retaining surfaces, which cam surfaces can be used to cause tape being pulled from the roll of tape on the side of the tab portions opposite the retaining surfaces to be guided between and around the tab portions to a position between the locating tab portions and the cutter support portion. Such guidance of the tape, however, requires purposeful manipulation of the dispenser, and if this is not properly done, the portion of the tape being withdrawn may not become positioned between the locating tab portions and the cutter support portion when the cutting edge is brought into engagement to transversely cut the tape so that that newly cut end portion can again adhere to the surface of the roll of tape rather than to the retaining surfaces.

DISCLOSURE OF THE INVENTION

The present invention provides a dispenser similar to the dispensers described above that more easily and consistently positions the newly cut end portions of the tape on the dispenser between locating tab portions and a cutter support portion of the dispenser and retains it in that location by releasable adhesion to retaining surfaces so that newly cut end portions of the tape will not again adhere to the surface of the roll of tape, but instead will be presented where they can be easily manually engaged to afford dispensing new lengths of tape from the dispenser.

The tape dispenser according to the present invention comprises an integrally molded polymeric frame that comprises (1) a cutter support portion having means along one end providing a cutting edge adapted to transversely cut the tape, (2) opposite side wall portions attached along opposite side edges of the cutter support portion that are disposed generally at right angles to the cutter support portion and to the cutting edge, (3) at least one hub portion projecting from one of the side wall portions, the hub portion having a peripheral surface adapted to support the cylindrical inner surface of the core for rotation about an axis generally parallel to said tape cutting edge, and being adapted to project into the opening in the core from one end of the core to support the roll of tape for rotation about the hub portion; and (4) opposed spaced locating tab portions projecting toward each other from the side wall portions at a distance from the axis that is significantly less than the distance between the cutting edge and the axis, which locating tab portions have retaining surfaces adjacent the cutter support portion to which newly cut end portions of the tape may be releasably adhered to retain those end portions of the tape in a position projecting from the roll at which they may be manually engaged to afford withdrawing another length of tape from the roll. Also, the locating tab portions have opposed cam surfaces extending from the side wall portions to spaced adjacent ends of the locating tab portions on the sides of the locating tab portions opposite the retaining surfaces, which cam surfaces cause tape being pulled from the roll of tape on the side of the tab portions opposite the retaining surfaces to be guided between and around the tab portions when relative movement is caused between the dispenser and the tape being withdrawn to transversely cut the tape with the cutting edge.

The tape dispenser according to the present invention is significantly improved when compared to the prior art dispenser described above in that it easily and consistently causes tape being pulled from the roll of tape on the side of the locating tab portions opposite the retaining surfaces to be consistently guided between and around the locating tab portions without further relative manipulation of the dispenser and the tape being withdrawn when relative movement is caused between the dispenser and the tape being withdrawn to transversely cut the tape with the cutting edge, and causes the newly cut end portion of the tape to consistently and firmly adhere to the retaining surface to retain that end portion of the tape in a position at which it may easily be manually engaged to afford withdrawing another length of tape from the dispenser.

The combination of structural features of the tape dispenser according to the present invention that provide these features include one or more of the following.

(1) The space between the adjacent spaced ends of the locating tab portions is at least 60 percent of the width of the tape the dispenser is intended to dispense (e.g., at least 1.2 inch for dispensers for 2 inch wide tape);

(2) The parts of the opposed cam surfaces on the locating tab portions that extend from the side wall portions to the adjacent spaced ends of the locating tab portions on the sides of the locating tab portions opposite the retaining surfaces are disposed at angles of greater than about 45 degrees, and preferably greater than about 50 degrees, with respect to the surfaces adjacent the cutter support portion of imaginary planes passing through the axis of the hub portions and those parts; the measurements of those angles being taken in planes normal to the surfaces of the imaginary planes. These angles of the cam surfaces, in combination with the space between the locating tab portions, facilitates smooth movement of the tape along the cam surfaces and around the locating tab portions (if necessary) when the tape and dispenser are moved to a position where the cutting edge will cut the tape being dispensed;

(3) the retaining surfaces on the opposed locating tab portions that project toward each other from the side wall portions are spaced from the cutter support portion so that a first imaginary plane passing through the axis of the hub portions and the cutting edge is disposed at an angle of at least 12 degrees and preferably at least 20 degrees with respect to a second imaginary plane that passes through the axis of the hub portions and is tangent to the retaining surfaces of the locating tab portions. The width of this space (which is unobstructed) between the cutting edge and the retaining surfaces together with the ease with which the tape can be pulled between the locating tab portions insures that the tape will be consistently pulled into that space when it is cut by the cutting edge (thereby assuring that the newly cut end portion of the tape will contact the retaining surfaces after it is formed) when the cutting edge is moved into engagement with the tape after tape has been withdrawn from the side of the locating tab portions opposite the cutter support portion; and (4) The retaining surfaces on the opposed locating tab portions are convex and arcuate about an axis parallel to the axis of the hub portions, which provides retaining surfaces to be adhered to by the newly formed end portions of the tape that are compatible in shape with the normally slightly concave inner adhesive coated surface of those end portions, thereby facilitating adhesion of the tape to the retaining surfaces.

BRIEF DESCRIPTION OF DRAWING

The present invention will be further described with reference to the accompanying drawing wherein like reference numerals refer to like parts in the several views, and wherein.

DESCRIPTION OF THE PREFERRED EMBODIMENT

Figure 1:
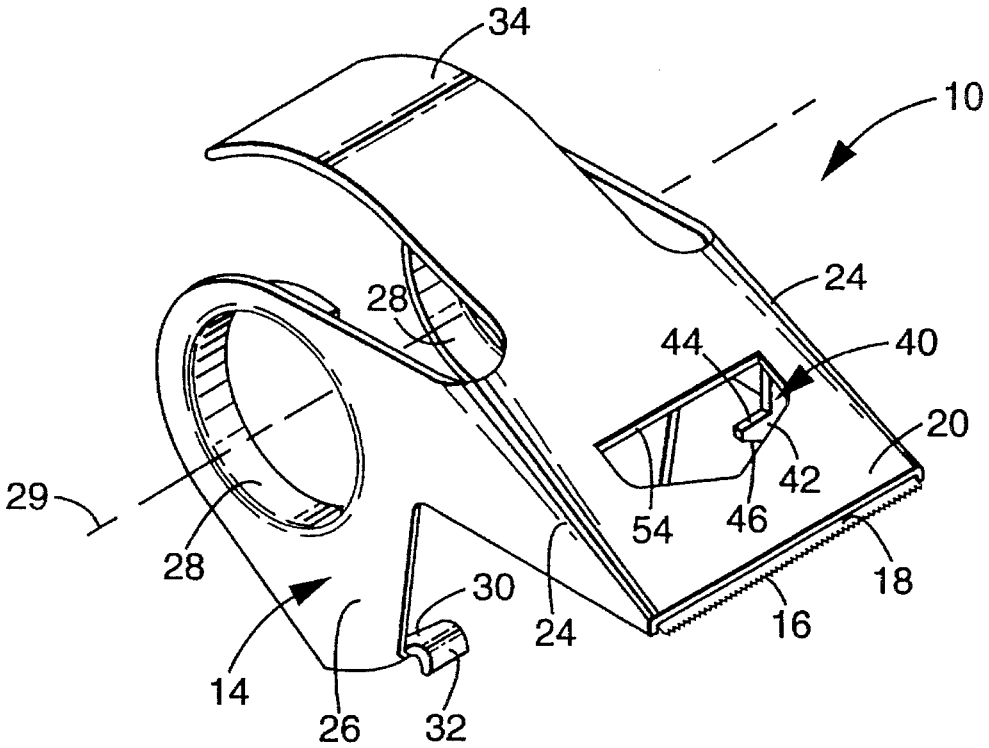
FIG. 1 is a perspective view of a first embodiment of a tape dispenser according to the present invention.
Figure 2:
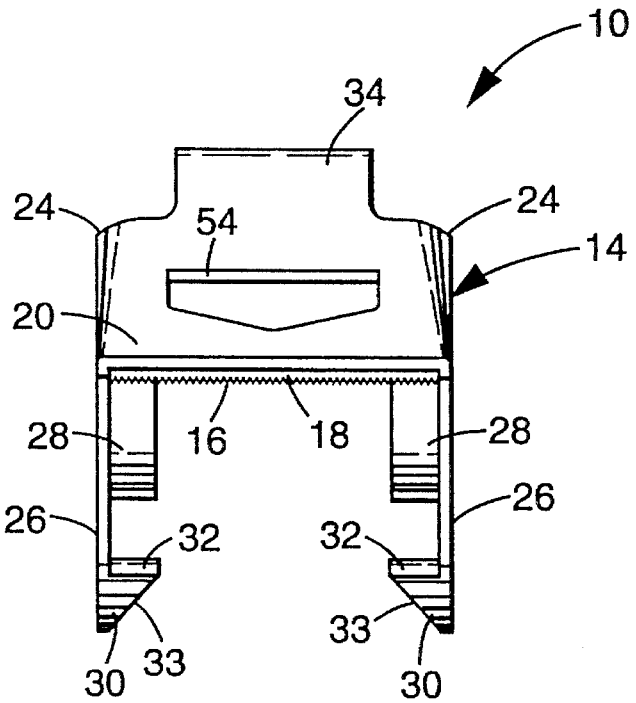
FIG. 2 is a front view of the tape dispenser shown in FIG. 1.
Figure 3:
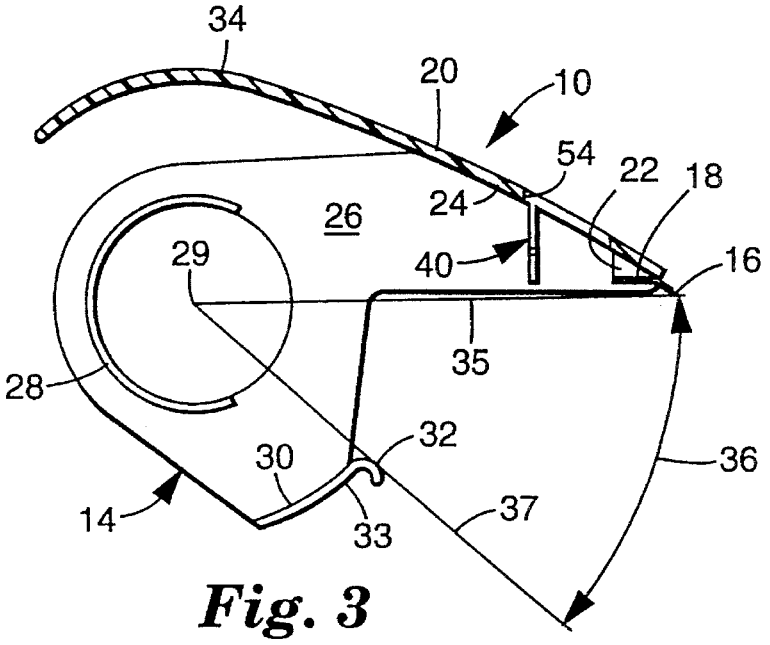
FIG. 3 is a cross sectional view of the dispenser of FIG. 1 taken approximately along line 3—3 of FIG. 2.
Figure 4:
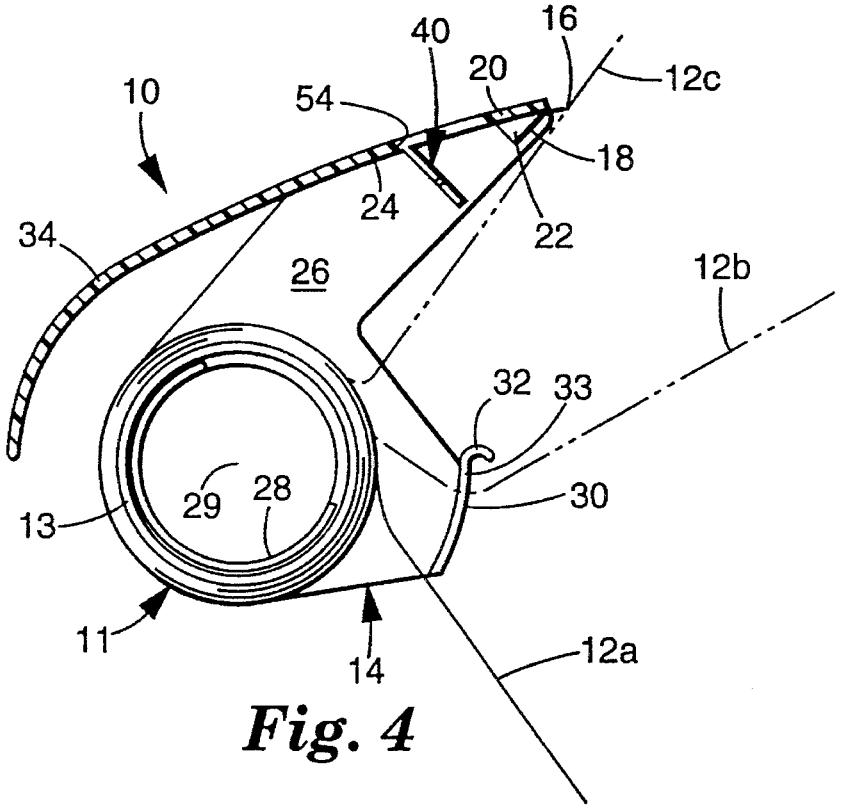
FIGS. 4 and 5 are cross sectional views similar to that of FIG. 3 illustrating a roll of tape in the dispenser and various positions of end portions of tape on that roll.
Figure 5:
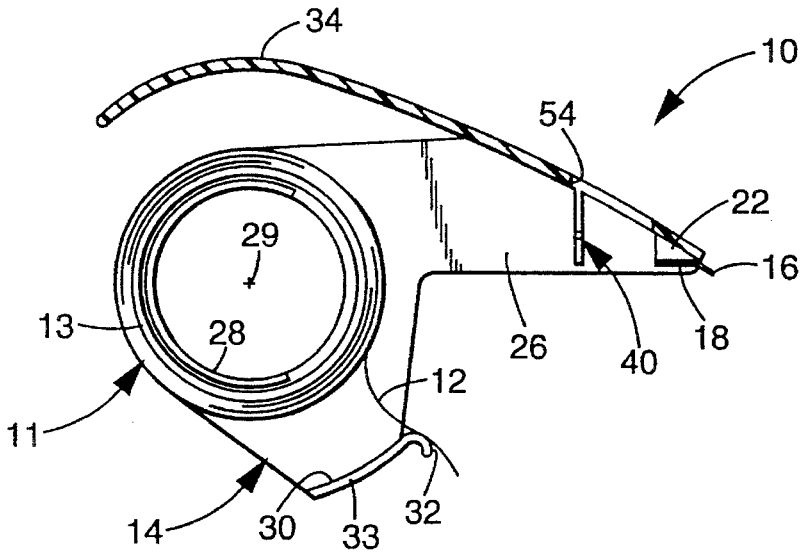
Figure 6:
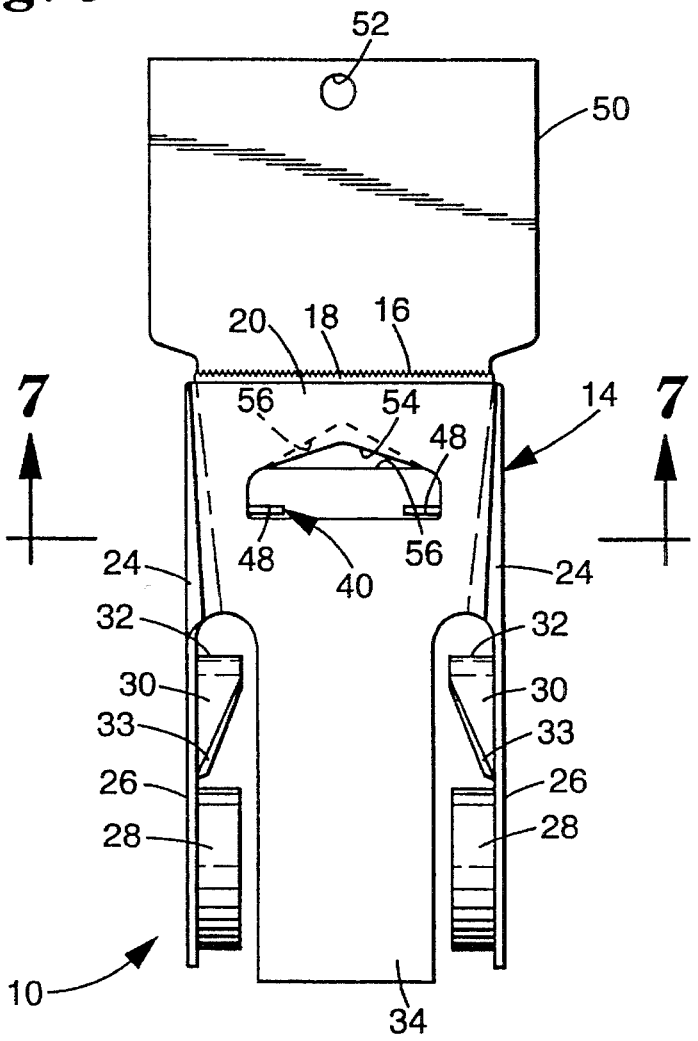
FIG. 6 is a top view of the tape dispenser shown in FIG. 1 in combination with a card by which the dispenser can be hung on a peg.
Figure 7:
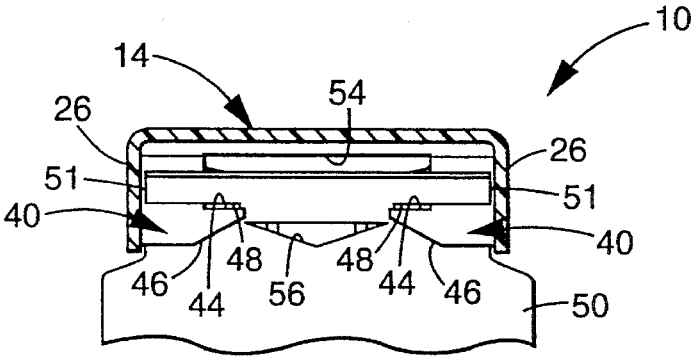
FIG. 7 is a cross sectional view of the dispenser and a fragment of the card of FIG. 6 taken approximately along line 7—7 of FIG. 6.

Referring now to FIGS. 1 through 8 of the drawing, there is shown a first embodiment of a tape dispenser 10 according to the present invention for a roll of tape 11 including a supply length of tape 12 wound on a core 13 (e.g., the 2 inch wide tape including a coating of aggressive pressure sensitive adhesive that may have a clear or tan colored polypropylene backing or a polymeric backing that includes longitudinally extending fiberglass filaments that is sold as packaging or mailing tape by Minnesota Mining and Manufacturing Company, St. Paul, Minn.). The dispenser 10 comprises a frame 14 integrally molded of a polymeric material (e.g., polystyrene), and a thin metal plate or blade 18 attached to the frame 14. The metal plate or blade 18 provides means for defining a generally straight tape cutting edge 16 comprising a row of generally triangular teeth that are adapted to transversely cut the tape without being excessively sharp so that they do not cause an undue risk of cutting a person using the dispenser 10.

The frame 14 of the dispenser 10 comprises a projecting cutter support portion 20 having a generally planar outer surface, and having spaced, parallel triangular ribs 22 along its inner surface on which the blade 18 is mounted with its cutting edge 16 at an outer end of the support portion 20. Opposite, generally parallel side wall portions 26 of the frame 13 are attached along opposite edges 24 of the support portion and are disposed at about right angles with respect to the cutting edge 16 and with respect to the support portion 20. The side wall portions 26 of the frame support opposed semi-cylindrical hub portions 28 of the frame 14 that project toward each other from the inner surfaces of the side wall portions 26 around parts of the peripheries of circular openings through the side wall portions 26. The hub portions 28 are arcuate about an axis 29 parallel to the tape cutting edge 16, provide peripheral surfaces adapted to rotatably support the cylindrical inner surface of the core 13 for rotation about the axis 29, and are adapted to project into the opposite ends of an opening in the core 13 on the side of the core opposite the blade to rotatably support the roll of tape 11. The side wall portions 26 are resiliently flexible between the hub portions 28 and the support portion 20 so that they can be resiliently bent apart to afford positioning the roll of tape 11 between the hub portions 28 and removing the empty core 13 from therebetween.

The frame 14 also includes opposed locating tab portions 30 projecting toward each other from the adjacent surfaces of the side wall portions 26 at a distance from the axis 29 of the hub portions 28 (e.g., 1.38 inches) that is significantly less than or about half plus or minus 10 percent the distance between the cutting edge 16 and the axis 29 of the hub portions 28 (e.g., 2.76 inches). The locating tab portions 30 have retaining surfaces 32 adjacent the cutter support portion 20 that are arcuate or cylindrically convex about an axis parallel to the axis 29 of the hub portions 28, and are spaced from the support portion 20 so that a first imaginary plane 35 (FIG. 3) through the axis 29 of the hub portions 28 and the cutting edge 16 is disposed at an angle 36 of at least 12 degrees and preferably in the range of 20 to 70 degrees (e.g., about 38 degrees as illustrated) from a second imaginary plane 37 through the axis 29 of the hub portions 28 that is tangent to the retaining surfaces 32 of the locating tab portions 30. The space between the first and second imaginary planes is unobstructed by any portion of the dispenser 10.

The locating tab portions 30 also have cam surfaces 33 extending from adjacent the side wall portions 26 to the adjacent or inner ends of the locating tab portions 30 on the sides of the locating tab portions 30 opposite the retaining surfaces 32, which cam surfaces 33 cause tape 12 being pulled from the roll of tape 11 on the side of the tab portions 30 opposite the retaining surfaces 32 to be guided between and around the locating tab portions 30 when relative movement is caused between the dispenser and the tape 12 being withdrawn to transversely cut the tape 12 with the cutting edge 16. The parts of the cam surfaces 33 along the lengths of the cam surfaces 33 are disposed at angles of greater than about 45 degrees, and preferably greater than about 50 degrees, with respect to the surfaces adjacent the cutter support portion 20 of imaginary planes passing through the axis 29 of the hub portions 28 and those parts; the measurements of those angles being taken in planes normal to the surfaces of the imaginary planes. The cam surfaces 33 can be straight or arcuate, include straight and arcuate parts, or include different parts that are arcuate about different axes or are straight and disposed at different angles with respect to the imaginary planes. Also, the opposite ends of the cam surfaces 33 can be disposed at the same or different distances from the axis 29 of the hub portions 28.

The locating tab portions 30 project a small distance into the path of the tape (e.g., 0.33 inch into the path on each side of the path for 2 inch wide tape that the dispenser 10 is adapted to dispense) thereby requiring only a small percentage of the width of the tape 12 (e.g., about 27 percent) to be moved around the locating tab portions 30 by the cam surfaces 33. Thus the space between the adjacent spaced ends of the locating tab portions 30 is at least 60 percent (e.g., 73 percent) of the width of the 2 inch tape the dispenser is intended to dispense.

An arched portion 34 of the frame 13 is joined to and projects from the edge of the support portion 20 opposite the cutting edge 16, and extends partially around the roll of tape 11. The arched portion 34 is resiliently flexible and has a generally cylindrically concave surface adjacent the periphery of the roll of tape 11 in the dispenser 10. The arched portion 34 is adapted to be received in the palm of a user's hand to normally space the user's hand from the rotating roll of tape 11 as tape 12 is being dispensed from the tape dispenser 10, and can be pressed into engagement with the periphery of the roll of tape 11 to stop tape from being withdrawn from the dispenser when the user wishes to sever the tape with the cutting edge 16. The arched portion 34 also insures that a user of the tape dispenser does not attempt to cut the tape 12 using the wrong side of the tape cutting edge 16.

The frame 14 of the dispenser 10 further includes an opposed pair of spaced and aligned plate-like attachment portions 40 (see FIGS. 1 and 7) each attached along adjacent edges to one of the side wall portions 26 and the cutter support portion 20. The attachment portions 40 are generally parallel to and spaced from the cutting edge 16 on the blade 18, and include opposed generally triangular projecting parts 42 at their adjacent ends that have inner edges 44 generally parallel to and spaced from the cutter support portion 20, and opposite outer edges 46 that are disposed at an acute angle (e.g., 25 degrees) with respect to their inner edges 44. The attachment portions 40 are adapted to be received in slots 48 formed in a flexible paper card 50 (see FIGS. 6 and 7) that can bear advertizing and other information about the dispenser 10 with end portions of the projecting parts 42 positioned over parts of the card 50 between the slots 48 and opposite edges 51 of the card 50 at the outer ends of the slots 48 abutting the inner surfaces of the side wall portions 26. Those parts of the card 50 between the slots 48 can be positioned beneath the ends of the projecting parts 42 by positioning the card 50 between the side wall portions 26 on the inclined outer edges 46 of the projecting parts 42 with the outer ends of the attachment portions 40 in the slots 48 and resiliently bending the card 50 between and transverse to the attachment portions 40 by pressing its center portion toward the cutter support portion 20 until the portion of the card 50 between the slots 48 passes between the adjacent ends of the projecting parts 42, whereupon the card 50 will straighten, leaving those parts of the card 50 beneath the ends of the projecting parts 42. The card 50 can have an opening 52 by which the card 50 and thereby the dispenser 10 can be hung on a pin, such as a pin at a product display area of a store. Aligned triangular openings 54 and 56 in the cutter support portion 20 and in the card 50 respectively can also receive a pin on which the card 50 and/or the dispenser 10 can be hung. A plurality of dispenser 10 and card 50 combinations can be hung on the same pin with one of each pair of successive combinations receiving the pin in the opening 52 and the other receiving the pin in the triangular openings 54 and 56 to cause the successive combinations to nest more closely together on the pin.

To use the dispenser 10, a user typically pulls an end of the length of tape 12 away from the tape on the roll 11, applies the end of the tape to the item to be taped, and pulls the dispenser 10 away from the item to dispense the desired length of tape 12. If the end of the length of tape 12 was initially adhered to the retaining surfaces 32, the tape will be pealed away from those retaining surfaces 32 and will be pulled from the roll in the space between the retaining surfaces 32 and the cutting edge 16 of the blade 18. If the end of the length of tape 12 is initially adhered to the roll 11 (as will be the case when the roll of tape 11 is new), the user pulls that end from the surface of the roll 11 which may most easily be done between the side wall portions 26 on the side of the locating tab portions 30 opposite the cutting edge 16 and the distal end of the arched portion 34. The user may continue to pull tape from the roll 11 in that area (see tape portion 12*a* in FIG. 4), however, when a sufficient length of the tape has been withdrawn, the user will orient the dispenser 10 to press the cutting edge 16 of the blade 18 against the tape 12 so that the edge 18 transversely severs the tape 12. Tension in the tape 12 during such orientation of the dispenser 10 will cause the cam surfaces 33 to guide the opposite edges of the tape 12 between and around the locating tab portions 30 (see dotted tape portion 12*b* in FIG. 4) and will position the tape 12 in the space between the retaining surfaces 32 and the cutting edge 16 (see dotted tape portion 12*c* in FIG. 4) before the cutting edge 16 can sever the tape 12. After the tape 12 is severed, the newly formed end portion of the tape 12 will contact and releasably adhere to the retaining surfaces 32 (see FIG. 5), which is facilitated because of the convex curvature of the retaining surfaces 32 and complimentary concave curvature of the newly formed end portion of the tape 12 that is caused by stresses formed in the backing of the tape 12 when it was wound on the roll 11. The adhesion of the newly formed end portion of the tape 12 to the retaining surfaces 32 will thus normally be retained until the end portion of the tape 12 is pealed away by a user when another length of the tape 12 is desired.

Figure 8:
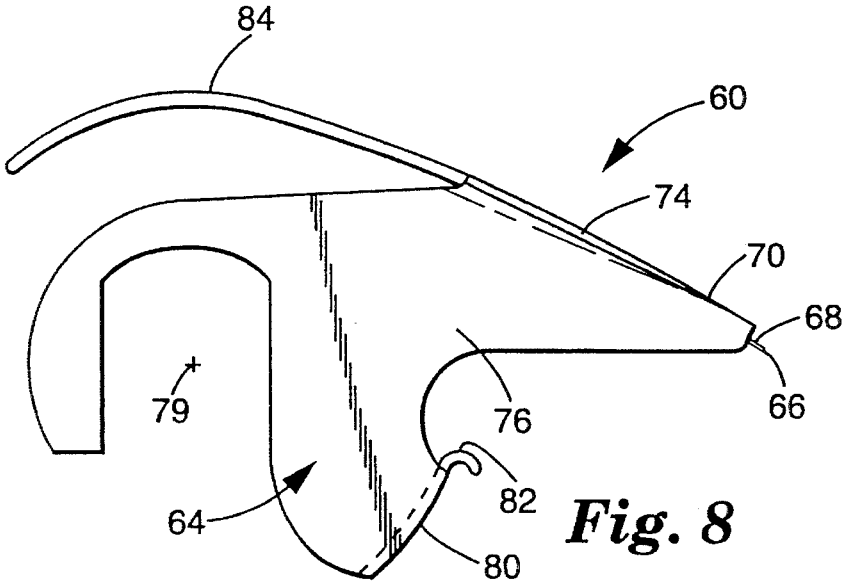
FIG. 8 is a side view of a second embodiment of a tape dispenser according to the present invention.
Figure 9:
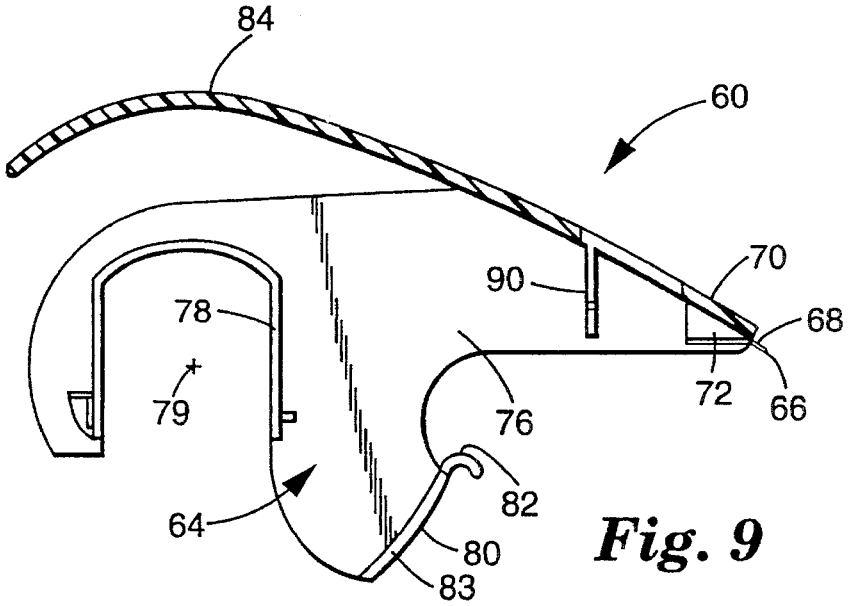
FIG. 9 is a longitudinal cross sectional view of the tape dispenser of FIG. 8 which is a mirror image of a longitudinal cross sectional view taken in the opposite direction through the dispenser.

Referring now to FIGS. 8 and 9 of the drawing, there is shown a second embodiment of a tape dispenser 60 according to the present invention for a roll of tape including a supply length of tape wound on a core. The dispenser 60 comprises a frame 64 integrally molded of a polymeric material, and a thin metal plate or blade 68 attached to the frame 64 that is essentially the same as the blade 18 described above and provides means for defining a generally straight tape cutting edge 66. The frame 64 of the dispenser 60 comprises a projecting cutter support portion 70 including triangular ribs 72 on which the blade 68 is mounted, an arched portion 84, and an opposed pair of spaced and aligned plate-like attachment portions 90 by which the dispenser 60 can be hung using the card 50 described above, which portions 70, 84 and 90 are essentially the same as the corresponding portions 20, 34 and 40 of the dispenser 10 described above. The frame 63 also includes opposite side wall portions 76 attached along opposite edges 74 of the support portion 70 disposed at about right angles with respect to the cutting edge 66 and with respect to the support portion 70, which side wall portions 76 and two opposed hub portions 78 of the frame 13 that project toward each other from their inner surfaces differ in shape from but provide the same function as, the corresponding portions 26 and 28 of the dispenser 10. The hub portions 78 have peripheral surfaces adapted to rotatably support the cylindrical inner surface of the core of a roll of tape for rotation about an axis 79 parallel to the tape cutting edge 66, and are adapted to project into the opposite ends of an opening in that core to rotatably support the roll of tape. The parts of the side wall portions 76 supporting the hub portions 78 are generally C-shaped, and the side wall portions 76 are resiliently flexible between the hub portions 78 and the support portion 70 so that they can be resiliently bent apart to afford positioning the roll of tape 11 between the hub portions 78 and removing the empty core 13 from therebetween. Alternatively, adjacent ends of the hub portions 78 could be joined by sonic welding or a suitable adhesive after the roll of tape 11 is positioned about them which adds stability to the frame 64 but makes the dispenser 60 disposable, or adjacent ends of the hub portions 78 could be releasably attached to each other by means such as those described in U.S. Pat. No. 4,627,560, the content whereof is incorporated herein by reference.

The frame 64 also includes opposed locating tab portions 80 that have essentially the same shape as the locating tab portions 30 on the dispenser 10 and project toward each other from the adjacent surfaces of the side wall portions 76 at a distance from the axis 79 of the hub portions 78 (e.g., about 1.38 inches) that is significantly less than or about one half (plus or minus 10 percent) of the distance between the cutting edge 66 and the axis 79 of the hub portions 78 (e.g., 2.76 inches). The locating tab portions 80 have retaining surfaces 82 adjacent the cutter support portion 70 that are arcuate or cylindrically convex about an axis parallel to the axis 79 of the hub portions 78, and are spaced from the support portion 70 so that a first imaginary plane through the axis 79 of the hub portions 78 and the cutting edge 66 is disposed at an angle of at least 20 degrees and in the range of 20 to 70 degrees (about 20 degrees as illustrated) from a second imaginary plane through the axis 79 of the hub portions 78 that is tangent to the retaining surfaces 82 of the locating tab portions 80. The locating tab portions 80 also have cam surfaces 83 extending from the side wall portions 76 to the adjacent or inner ends of the locating tab portions 80, which cam surfaces 83 cause tape 12 being pulled from the roll of tape 11 on the side of the tab portions 80 opposite the retaining surfaces 82 to be guided between and around the tab portions 80 when relative movement is caused between the dispenser and the tape 12 being withdrawn to transversely cut the tape 12 with the cutting edge 66. The parts of the cam surfaces 83 along the lengths of the cam surfaces 83 are disposed at angles of greater than about 45 degrees, and preferably greater than about 50 degrees, with respect to the surfaces adjacent the cutter support portion 70 of imaginary planes passing through the axis 79 of the hub portions 78 and those parts of the cam surfaces 83; the measurements of those angles being taken in planes normal to the surfaces of the imaginary planes.

The present invention has now been described with reference to two embodiments thereof. It will be apparent to those skilled in the art that many changes can be made in the embodiments described without departing from the scope of the present invention. Thus the scope of the present invention should not be limited to the structure described in this application, but only by structures described by the language of the claims and the equivalents of those structures.

We claim:

1. A tape dispenser for a roll of tape including a supply length of the tape wound around a core, which core has opposite ends and a through opening defined by a cylindrical inner surface between the ends, said dispenser comprising means for defining a cutting edge adapted to transversely cut the tape, and a frame integrally molded of a polymeric material, said frame comprising:

a cutter support portion having said means for defining a cutting edge along one end and having spaced side edges disposed at about right angles with respect to said cutting edge;

opposite side wall portions attached along said opposite side edges of the cutter support portion and having opposed adjacent inner surfaces;

opposed hub portions projecting toward each other from the side wall perilous, said hub portions having peripheral surfaces adapted to support the cylindrical inner surface of the core for rotation about an axis generally parallel to said tape cutting edge, and being adapted to project into the opening in the core from opposite ends of the core to support the roll of tape for rotation about the hub portions; and opposed space locating tab penions projecting toward each other from the side wall portions at a distance from said axis that is significantly less than the distance between said cutting edge and said axis, said locating tab portions having retaining surfaces adjacent the guide portion that are convex and arcuate about an axis parallel to the axis of said hub portions and are spaced from the support portion so that a first plane passing through the axis of the hub portions and the cutting edge is disposed at an angle of at least 12 degrees with respect to a second plane that passes through the axis of the hub portions and is tangent to the retaining surfaces of the locating tab portions, said dispenser having unobstructed space adjacent the retaining surfaces between said first plane and said second plane, said locating tab portions having opposed cam surfaces extending from the side wall portions to the adjacent inner ends of the locating tab portions on the sides of said locating tab portions opposite said retaining surfaces, parts of the cam surfaces along the lengths of the cam surfaces being disposed at cam angles of greater than about 45 degrees with respect to the surfaces adjacent the cutter support portion of imaginary planes passing through said axis of the hub portion and said parts of the cam surfaces when the measurements of said cam angles are taken in planes normal to the surfaces of the imaginary planes;

said cam surfaces and the space between said retaining surfaces and said support member causing tape being pulled from the roll of tape on the hub portions on the side of said locating tab portions opposite said retaining surfaces to be consistently guided between and around said tab portions when relative movement is caused between said dispenser and said tape being withdrawn to bring said cutting edge into engagement to transversely cut the tape, and said retaining surfaces affording releasable adhesion thereto by a newly cut end portion of the tape to retain that end portion of the tape in a position projecting from the roll at which it may easily be manually engaged to afford withdrawing another length of tape from the roll.

2. A tape dispenser according to claim 1 wherein the space between the adjacent spaced ends of the locating tab portions is at least 60 percent of the width of the tape the dispenser is intended to dispense.

3. A tape dispenser according to claim 1 wherein said side wall portions are resiliently flexible between the hub portions and the support portion so that the side wall portions can be resiliently bent apart to afford positioning the tape roll between the hub portions and removing the empty core from therebetween.

4. A tape dispenser according to claim 1 wherein said frame further comprises a resiliently flexible arched portion attached to the edge of the support portion opposite said cutting edge and adapted to extend partially around the roll of tape, said arched portion having a generally cylindrically concave surface adjacent said hub portion.

5. A tape dispenser according to claim 1 wherein said first plane passing through the axis of the hub portions and the cutting edge is disposed at an angle in the range of about 20 to 70 degrees with respect to said second plane that passes through the axis of the hub portions and is tangent to the retaining surfaces of the locating tab portions; and said cam surfaces are disposed at an angle of less than about 30 degrees with respect to the inner surfaces of the side wall portions.

6. A tape dispenser according to claim 1 wherein said first plane passing through the axis of the hub portions and the cutting edge is disposed at an angle of about 38 degrees with respect to said second plane that passes through the axis of the hub portions and is tangent to the retaining surfaces of the locating tab portions; and said parts of the cam surfaces along the lengths of the cam surfaces are disposed at cam angles of greater than about 70 degrees with respect to the surfaces adjacent the cutter support portion of said imaginary planes passing through said axis of the hub portion and said parts of the cam surfaces when the measurements of said cam angles are taken in planes normal to the surfaces of the imaginary planes.

7. A tape dispenser according to claim 1 wherein said hub portions are semi-cylindrical and are disposed on the side of the axis of the hub portions opposite said cutting edge.

8. A tape dispenser for a roll of tape including a supply length of the tape wound around a core, which core has opposite ends and a through opening defined by a cylindrical inner surface between the ends, said dispenser comprising means for defining a cutting edge adapted to transversely cut the tape, and a frame of a polymeric material, said frame comprising:

a cutter support portion having said means for defining a cutting edge along one end and having spaced side edges disposed at about right angles with respect to said cutting edge;

opposite side wail portions attached along said opposite side edges of the cutter support portion and having opposed adjacent inner surfaces; at least one hub portion projecting from one of said side wall portions, said hub portion having a peripheral surface adapted to support the cylindrical inner surface of the core for rotation about an axis generally parallel to said tape cutting edge, and being adapted to project into the opening in the core from one end of the core to support the roll of tape for rotation about the hub portion; and opposed spaced locating tab portions projecting toward each other from the side wall portions at a distance from said axis that is significantly less than the distance between said cutting edge and said axis, said locating tab portions having retaining surfaces adjacent the cutter support portion That are spaced from the support portion so that a first plane passing through the axis of the hub portions and the cutting edge is disposed at an angle of at least 12 degrees with respect to a second plane that passes through the axis of the hub portions and is tangent to the retaining surfaces of the locating tab portions, said locating tab portions having opposed cam surfaces extending from the side wall portions to the adjacent inner ends of the locating tab portions on the sides of said locating tab portions opposite said retaining surfaces, said dispenser having unobstructed space adjacent the retaining surfaces between said first plane and said second plane, parts of the cam surfaces along the lengths of the cam surfaces being disposed at cam angles of greater than about 45 degrees with respect to the surfaces adjacent the cutter support portion of imaginary planes passing through said axis of the hub portion and said parts of the cam surfaces when the measurements of said cam angles are taken in planes normal to the surfaces of the imaginary planes;

said cam surfaces causing tape being pulled from the roll of tape on the hub portions on the side of said locating tab portions opposite said retaining surfaces to be guided between and around said tab portions when relative movement is caused between said dispenser and said tape being withdrawn to bring said cutting edge into engagement to transversely cut the tape, and said retaining surfaces affording releasable adhesion thereto by a newly cut end portion of the tape to retain that end portion of the tape in a position projecting from the roll at which it may easily be manually engaged to afford withdrawing another length of tape from the roll.

9. A tape dispenser according to claim 8 wherein the space between the adjacent spaced ends of the locating tab portions is at least 60 percent of the width of the tape the dispenser is intended to dispense.

10. A tape dispenser according to claim 8 wherein said retaining surfaces are convex and arcuate about an axis parallel to the axis of said hub portion.

11. A tape dispenser according to claim 8 wherein said first plane passing through the axis of the hub portions and the cutting edge is disposed at an angle in the range of about 20 to 70 degrees with respect to said second plane that passes through the axis of the hub portions and is tangent to the retaining surfaces of the locating tab portions; and said parts of the cam surfaces along the lengths of the cam surfaces are disposed at cam angles of greater than about 60 degrees with respect to the surfaces adjacent the cutter support portion of said imaginary planes passing through said axis of the hub portion and said parts of the cam surfaces when the measurements of said cam angles are taken in planes normal to the surfaces of the imaginary planes.

12. A tape dispenser according to claim 8 wherein said first plane passing through the axis of the hub portions and the cutting edge is disposed at an angle of about 38 degrees with respect to said second plane that passes through the axis of the hub portions and is tangent to the retaining surfaces of the locating tab portions; and said parts of the cam surfaces along the lengths of the cam surfaces are disposed at cam angles of greater than about 70 degrees with respect to the surfaces adjacent the cutter support portion of said imaginary planes passing through said axis of the hub portion and said parts of the cam surfaces when the measurements of said cam angles are taken in planes normal to the surfaces of the imaginary planes.

13. A tape dispenser for a roll of tape including a supply length of the tape wound around a core, which core has opposite ends and a through opening defined by a cylindrical inner surface between the ends, said dispenser comprising means for defining a cutting edge adapted to transversely cut the tape, and a frame of a polymeric material, said frame comprising:

a cutter support portion having said means for defining a cutting edge along one end and having spaced side edges disposed at about right angles with respect to said cutting edge;

opposite side wall portions attached along said opposite side edges of the cutter support portion and having opposed adjacent inner surfaces;

at least one hub portion projecting from one of said side wall portions, said hub portion having a peripheral surface adapted to support the cylindrical inner surface of the core for rotation about an axis generally parallel to said tape cutting edge, and being adapted to project into the opening in the core from one end of the core to support the roll of tape for rotation about the hub portion; and opposed spaced locating tab portions projecting toward each other from the side wall portions at a distance from said axis that is less than the distance between said cutting edge and said axis, said locating tab portions being spaced apart a predetermined distance and having retaining surfaces adjacent the cutter support portion that are spaced from the support portion so that a first plane passing through the axis of the hub portions and the cutting edge is disposed at a first predetermined angle with respect to a second plane that passes through the axis of the hub portions and is tangent to the retaining surfaces of the locating tab portions, said dispenser having unobstructed space adjacent the retaining surfaces between said first plane and said second plane, said locating tab portions having opposed cam surfaces extending from the side wall portions to the adjacent inner ends of the locating tab portions on the sides of said locating tab portions opposite said retaining surfaces, said parts of the cam surfaces along the lengths of the cam surfaces being disposed at predetermined cam angles with respect to the surfaces adjacent the cutter support portion of imaginary planes passing through said axis of the hub portion and said parts of the cam surfaces, which cam angles are measured in planes normal to the surfaces of the imaginary planes;

said predetermined distance, said first angle and said predetermined cam angles being adapted to cause tape being pulled from the roll of tape on the hub portions on the side of said locating tab portions opposite said retaining surfaces to be consistently guided between and around said tab portions without further relative manipulation of said dispenser and said tape being withdrawn when relative movement is caused between said dispenser and said tape being withdrawn to bring said cutting edge into engagement to transversely cut the tape, and said retaining surfaces affording releasable adhesion thereto by a newly cut end portion of the tape to retain that end portion of the tape in a position projecting from the roll at which it may easily be manually engaged to afford withdrawing another length of tape from the roll.

14. A tape dispenser according to claim 13 wherein said predetermined distance between the adjacent spaced ends of the locating tab portions is at least 60 percent of the width of the tape the dispenser is intended to dispense.

15. A tape dispenser according to claim 13 wherein said retaining surfaces are convex and arcuate about an axis parallel to the axis of said hub portion.

16. A tape dispenser according to claim 13 wherein said first angle is in the range of about 20 to 70 degrees.

17. A tape dispenser according to claim 13 wherein said predetermined cam angles are greater than 45 degrees.

18. A tape dispenser according to claim 13 wherein said first angle is about 38 degrees, said predetermined cam angles are greater than 70 degrees, and said predetermined distance between the adjacent spaced ends of the locating tab portions is about 60 percent of the width of the tape the dispenser is intended to dispense.

19. A tape dispenser according claim 13 wherein said frame further includes an opposed pair of spaced and aligned attachment portions between said side wall portions and along said cutter support portion, said attachment portions having opposite major surfaces that are generally parallel to and spaced from said cutting edge and including opposed generally triangular projecting parts at their adjacent ends, said projecting parts having inner edges between said major surfaces that arc generally parallel to and spaced from said cutter support portion, and opposite outer edges disposed at an acute angle with respect to said inner edges, said attachment portions being adapted to be received in aligned spaced slots formed in a flexible paper card that can bear advertising and other information about said dispenser and can have an opening by which the card and thereby the dispenser can be hung on a pin with end portions of the projecting parts positioned over parts of the card between the slots and opposite edges of the card at the outer ends of the slots abutting the inner surfaces of said side wall portions, the parts of the card between the slots being positionable beneath the ends of the projecting parts by positioning the card between the side wall portions on the inclined outer edges of the projecting parts with the outer ends of the attachment portions in the slots and resiliently bending the card between and transverse to the attachment portions by pressing its center portion toward the cutter support portion until the portion of the card between the slots passes between the adjacent ends of the projecting parts, whereupon the card will straighten, leaving said parts of the card beneath the ends of the projecting parts.

20. A tape dispenser according to claim 13 wherein said frame further includes an opposed pair of spaced and aligned attachment portions between said side wall portions and along said cutter support portion, said attachment portions having opposite major surfaces that are generally parallel to and spaced from said cutting edge and including opposed generally triangular projecting parts at their adjacent ends, said projecting parts having inner edges between said major surfaces that are generally parallel to and spaced from said cutter support portion, and opposite outer edges disposed at an acute angle with respect to said inner edges; and wherein said tape dispenser further includes a planar paper card having opposite parallel edges extending between opposite inner and outer ends of said card, and aligned spaced slots extending into said card from said edges adjacent said inner end, said attachment portions being received in said spaced slots with end portions of the projecting parts positioned over parts of the card between the slots and said opposite edges of the card at the outer ends of the slots abutting the inner surfaces of said side wall portions, the parts of the card between the slots having been positioned beneath the ends of the projecting parts by positioning the card between the side wall portions on the inclined outer edges of the projecting parts with the outer ends of the attachment portions in the slots and resiliently bending the card between and transverse to the attachment portions by pressing its center portion toward the cutter support portion until the portion of the card between the slots passed between the adjacent ends of the projecting parts, whereupon the card straightened, leaving said parts of the card beneath the ends of the projecting parts, said card bearing advertising and other information about said dispenser, having a major portion of said card adjacent said outer end projecting past said cutting edge, and having a first opening adjacent the outer end of said card by which the card and thereby the dispenser can be hung on a pin.

21. A tape dispenser according to claim 20 wherein said card and said cutter support portion have aligned openings that can receive a pin on which the card and dispenser can be hung, said frame being shaped and said first opening in said card and said aligned openings being positioned so that a plurality of dispensers can be hung on the same pin with one of each pair of successive dispensers receiving the pin in the first opening and the other receiving the pin in the aligned openings to cause the successive dispensers to nest more closely together on the pin.

22. A tape dispenser for a roll of tape including a supply length of the tape wound around a core, which core has opposite ends and a through opening defined by a cylindrical inner surface between the ends, said dispenser comprising means for defining a cutting edge adapted to transversely cut the tape, and a frame of a polymeric material, said frame comprising:

a cutter support portion having said means for defining a cutting edge along one end and having spaced side edges disposed at about right angles with respect to said cutting edge;

opposite side wall portions attached along said opposite side edges of the cutter support portion and having opposed adjacent inner surfaces;

at least one hub portion projecting from one of said side wall portions, said hub portion having a peripheral surface adapted to support the cylindrical inner surface of the core for rotation about an axis generally parallel to said tape cutting edge, and being adapted to project into the opening in the core from one end of the core to support the roll of tape for rotation about the hub portion; and an opposed pair of spaced and aligned attachment portions between said side wall portions and along said cutter support portion, said attachment portions having opposite major surfaces that are generally parallel to and spaced from said cutting edge and including opposed generally triangular projecting parts at their adjacent ends, said projecting parts having inner edges between said major surfaces that are generally parallel to and spaced from said cutter support portion, and opposite outer edges disposed at an acute angle with respect to said inner edges, said attachment portions being adapted to be received in aligned spaced slots formed in a flexible paper card that can bear advertising and other information about said dispenser and can have an opening by which the card and thereby the dispenser can be hung on a pin with end portions of the projecting parts positioned over parts of the card between the slots and opposite edges of the card at the outer ends of the slots abutting the inner surfaces of said side wall portions, the parts of the card between the slots being positionable beneath the ends of the projecting parts by positioning the card between the side wall portions on the inclined outer edges of the projecting parts with the outer ends of the attachment portions in the slots and resiliently bending the card between and transverse to the attachment portions by pressing its center portion toward the cutter support portion until the portion of the card between the slots passes between the adjacent ends of the projecting parts, whereupon the card will straighten, leaving said parts of the card beneath the ends of the projecting parts.

23. A tape dispenser for a roll of tape including a supply length of the tape wound around a core, which core has opposite ends and a through opening defined by a cylindrical inner surface between the ends, said dispenser comprising means for defining a cutting edge adapted to transversely cut the tape, and a frame of a polymeric material, said frame comprising;

a cutter support portion having said means for defining a cutting edge along one end and having spaced side edges disposed at about right angles with respect to said cutting edge;

opposite side wall portions attached along said opposite side edges of the cutter support portion and having opposed adjacent inner surfaces;

at least one hub portion projecting from one of said side wall portions, said hub portion having a peripheral surface adapted to support the cylindrical inner surface of the core for rotation about an axis generally parallel to said tape cutting edge, and being adapted to project into the opening in the core from one end of the core to support the roll of tape for rotation about the hub portion; and an opposed pair of spaced and aligned attachment portions between said side wall portions and along said cutter support portion, said attachment portions having opposite major surfaces that are generally parallel to and spaced from said cutting edge and including opposed generally triangular projecting parts at their adjacent ends, said projecting parts having inner edges between said major surfaces that are generally parallel to and spaced from said cutter support portion, and opposite outer edges disposed at an acute angle with respect to said inner edges; and said tape dispenser further including a planar paper card having opposite parallel edges extending between opposite inner and outer ends of said card, and aligned spaced slots extending into said card from said edges adjacent said inner end, said attachment portions being received in said spaced slots with end portions of the projecting parts positioned over parts of the card between the slots and said opposite edges of the card at the outer ends of the slots abutting the inner surfaces of said side wall portions, the parts of the card between the slots having been positioned beneath the ends of the projecting parts by positioning the cud between the side wall portions on the inclined outer edges of the projecting parts with the outer ends of the attachment portions in the slots and resiliently bending the card between and transverse to the attachment portions by pressing its center portion toward the cutter support portion until the portion of the card between the slots passed between the adjacent ends of the projecting parts, whereupon the card straightened, leaving said parts of the card beneath the ends of the projecting parts, said card bearing advertising and other information about said dispenser, having a major portion of said card adjacent said outer end projecting past said cutting edge, and having a first opening adjacent the outer end of said card by which the card and thereby the dispenser can be hung on a pin.

24. A tape dispenser according to claim 23 wherein said card and said cutter support portion have aligned openings that can receive a pin on which the card and dispenser can be hung, said frame being shaped and said first opening in said card and said aligned openings being positioned so that a plurality of dispensers can be hung on the same pin with one of each pair of successive dispensers receiving the pin in the first opening and the other receiving the pin in the aligned openings to cause the successive dispensers to nest more closely together on the pin.

* * * * *

UNITED STATES PATENT AND TRADEMARK OFFICE

CERTIFICATE OF CORRECTION

PATENT NO.: 5,468,332

DATED: November 21, 1995

INVENTOR(S): Dretzka et al.

It is certified that error appears in the above-identified patent and that said Letters Patent is hereby corrected as shown below:

Column 9, line 11, "perilous" should be -- portions --.

Column 9, line 18, "penions" should be -- portions --.

Signed and Sealed this

Third Day of June, 1997

*Attest:*

Bruce Lehman

BRUCE LEHMAN

*Attesting Officer*

*Commissioner of Patents and Trademarks*